US009383719B2

(12) United States Patent
Hoshi

(10) Patent No.: US 9,383,719 B2
(45) Date of Patent: Jul. 5, 2016

(54) CARTRIDGE AND IMAGE FORMING APPARATUS

(71) Applicant: CANON KABUSHIKI KAISHA, Tokyo (JP)

(72) Inventor: Nobuharu Hoshi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 14/032,431

(22) Filed: Sep. 20, 2013

(65) Prior Publication Data

US 2014/0093271 A1 Apr. 3, 2014

(30) Foreign Application Priority Data

Oct. 1, 2012 (JP) ..... 2012-219773

(51) Int. Cl.
*G03G 21/18* (2006.01)
*G03G 15/08* (2006.01)

(52) U.S. Cl.
CPC ..... *G03G 21/1803* (2013.01); *G03G 15/0817* (2013.01); *G03G 15/0898* (2013.01); *G03G 21/1828* (2013.01)

(58) Field of Classification Search
CPC ..... G03G 15/0817; G03G 15/0881; G03G 15/0898; G03G 21/1803; G03G 21/181; G03G 21/1828; G03G 2215/00991
See application file for complete search history.

(56) References Cited

U.S. PATENT DOCUMENTS 5,485,249 A 1/1996 Higeta et al.
5,697,021 A 12/1997 Watanabe et al.
5,740,499 A 4/1998 Higeta et al.
5,809,374 A 9/1998 Tsuda et al.
6,078,763 A 6/2000 Hoshi
6,442,359 B1 8/2002 Numagami et al.
6,463,233 B2 10/2002 Kojima et al.
6,577,831 B1 6/2003 Numagami et al.
6,823,153 B2 11/2004 Ueno et al.
6,865,357 B2 3/2005 Fujita et al.
6,873,815 B2 3/2005 Matsuda et al.
6,990,302 B2 1/2006 Toba et al.

(Continued)

FOREIGN PATENT DOCUMENTS

JP H 07-121085 A 5/1995
JP 2004-170803 A 6/2004

OTHER PUBLICATIONS

Office Action in Chinese Patent Application No. 201310460113.5, dated Dec. 22, 2015 (with English translation).

*Primary Examiner* — David Gray
*Assistant Examiner* — Carla Therrien
(74) *Attorney, Agent, or Firm* — Fitzpatrick, Cella, Harper & Scinto

(57) ABSTRACT

A cartridge detachably mountable to a main assembly of an image forming apparatus includes: a frame; an accommodating portion, constituted by the frame, for accommodating a developer; a seal portion for preventing the developer from being leaking out from the accommodating portion, wherein the seal portion is formed by injection molding at a seal forming portion provided on the frame and is projected from the seal forming portion; and a sprue which is formed integrally with the seal portion by a resin material remaining in a path for permitting flow of the resin material melted when the seal portion is formed by the injection molding and which is projected from the frame in a position different from a position of the seal portion so as to be higher than the seal portion on the basis of the frame.

30 Claims, 15 Drawing Sheets

(56) References Cited

U.S. PATENT DOCUMENTS

| | | | | |
|---|---|---|---|---|
| 7,027,756 | B2 | 4/2006 | Hoshi et al. | |
| 7,072,594 | B2 | 7/2006 | Hoshi et al. | |
| 7,127,194 | B2 | 10/2006 | Hoshi et al. | |
| 7,162,174 | B2 | 1/2007 | Suzuki et al. | |
| 7,162,181 | B2 | 1/2007 | Maeshima et al. | |
| 7,346,293 | B2 | 3/2008 | Suzuki et al. | |
| 7,349,649 | B2 | 3/2008 | Hoshi et al. | |
| 7,912,404 | B2 | 3/2011 | Hoshi et al. | |
| 7,933,534 | B2 | 4/2011 | Hoshi et al. | |
| 8,682,211 | B2 * | 3/2014 | Hoshi et al. | 399/103 |
| 8,965,243 | B2 * | 2/2015 | Hayashida | 399/106 |
| 2009/0245851 | A1 * | 10/2009 | Hoshi et al. | 399/103 |
| 2010/0150604 | A1 * | 6/2010 | Hayashida et al. | 399/105 |
| 2011/0170903 | A1 | 7/2011 | Hoshi et al. | |
| 2011/0286762 | A1 * | 11/2011 | Hoshi et al. | 399/103 |
| 2013/0022368 | A1 | 1/2013 | Takarada et al. | |
| 2013/0121720 | A1 | 5/2013 | Hoshi et al. | |
| 2013/0129375 | A1 * | 5/2013 | Yamasaki et al. | 399/103 |
| 2013/0129378 | A1 | 5/2013 | Hoshi et al. | |
| 2013/0142541 | A1 * | 6/2013 | Hayashida | 399/106 |
| 2014/0064776 | A1 * | 3/2014 | Yamasaki et al. | 399/102 |
| 2014/0376953 | A1 * | 12/2014 | Kakuta et al. | 399/102 |

* cited by examiner (a)

(b)

(a)

(b)

CARTRIDGE AND IMAGE FORMING APPARATUS

FIELD OF THE INVENTION AND RELATED ART

The present invention relates to a process cartridge detachably mountable to an image forming apparatus and relates to the image forming apparatus.

In an electrophotographic image forming apparatus using an electrophotographic image forming process, an electrophotographic photosensitive member and a process means actable on the photosensitive member are integrally assembled into a unit to prepare a process cartridge. Further, a type in which this process cartridge is made detachably mountable to a main assembly of the image forming apparatus is employed.

In such a process cartridge, in order to prevent leakage of a developer (toner) to an outside of the process cartridge, a constitution in which sealing with a plurality of seal members is made between cartridge frames constituting the process cartridge and between parts constituting the process cartridge is employed.

As the seal member, an elastic member such as an urethane foam, a soft rubber or an elastomer resin material is used. Further, the seal member is bonded with accuracy at connecting portions between the frames and between the parts.

In recent years, in order to realize cost reduction by an increase in manufacturing efficiency and to realize quality stability during assembling, the process cartridge has been manufactured by an automatic machine using devices in respective assembling steps without performing a manual assembling operation. Further, with respect to the seal member described above, from a viewpoint of an assembling property by the automatic machine, a constitution in which the seal member is directly formed on the cartridge frame by two-color (coinjection) molding or the like has been proposed (Japanese Laid-Open Patent Application (JP-A) Hei 7-121085).

However, in this conventional proposal, there was the following problem. That is, in the case where the seal member is molded on the cartridge frame by using the two-color molding, due to a constraint by a mold constitution such as a mold removing direction, a shape of the seal member is limited, and therefore it is difficult to form the seal member having a shape satisfying a necessary function. Further, in order to solve such a problem, a type in which the seal member is directly formed on the cartridge frame by bringing a mold later in contact with a molded cartridge frame and by bringing a gate portion of a resin material injecting device into contact with a resin material injecting port for injecting a melted resin material into the mold, and then by injecting the resin material into a space between the mold and the cartridge frame has been proposed.

In this case, a seal portion and a projected sprue (projected injected resin portion or molded portion) are formed when the resin material is injected from a projected sprue to an end portion of a seal portion, a projection-shaped stepped portion is formed between the end portion and the sprue. The end portion of the seal portion is a seal function portion contactable to another part in order to seal (confine) the toner, and therefore when the projection-shaped stepped portion is formed at the end portion contactable to another part, there is a fear that a sealing property is worsened and thus the toner is leaked out. Further, it would be also considered that the sprue is provided in a position different from a position of the end portion, but in that case, in order to maintain strength of the mold, there is a need to form the sprue in a spaced state from the end portion to some extent, so that there is a problem that an increase in size of the seal member is invited.

SUMMARY OF THE INVENTION

Therefore, a principal object of the present invention is to provide a cartridge and an image forming apparatus which are capable of improving a sealing property while suppressing an increase in size of a seal member.

According to an aspect of the present invention, there is provided a cartridge detachably mountable to a main assembly of an image forming apparatus, comprising: a frame; an accommodating portion, constituted by the frame, for accommodating a developer; a seal portion for preventing the developer from being leaking out from the accommodating portion, wherein the seal portion is formed by injection molding at a seal forming portion provided on the frame and is projected from the seal forming portion; and a sprue which is formed integrally with the seal portion by a resin material remaining in a path for permitting flow of the resin material melted when the seal portion is formed by the injection molding and which is projected from the frame in a position different from a position of the seal portion so as to be higher than the seal portion on the basis of the frame.

According to another aspect of the present invention, there is provided an image forming apparatus for forming an image on a recording material, comprising: a frame; an accommodating portion, constituted by the frame, for accommodating a developer; a seal portion for preventing the developer from being leaking out from the accommodating portion, wherein the seal portion is formed by injection molding at a seal forming portion provided on the frame and is projected from the seal forming portion; and a sprue which is formed integrally with the seal portion by a resin material remaining in a path for permitting flow of the resin material melted when the seal portion is formed by the injection molding and which is projected from the frame in a position different from a position of the seal portion so as to be higher than the seal portion on the basis of the frame.

These and other objects, features and advantages of the present invention will become more apparent upon a consideration of the following description of the preferred embodiments of the present invention taken in conjunction with the accompanying drawings.

Figure 5:
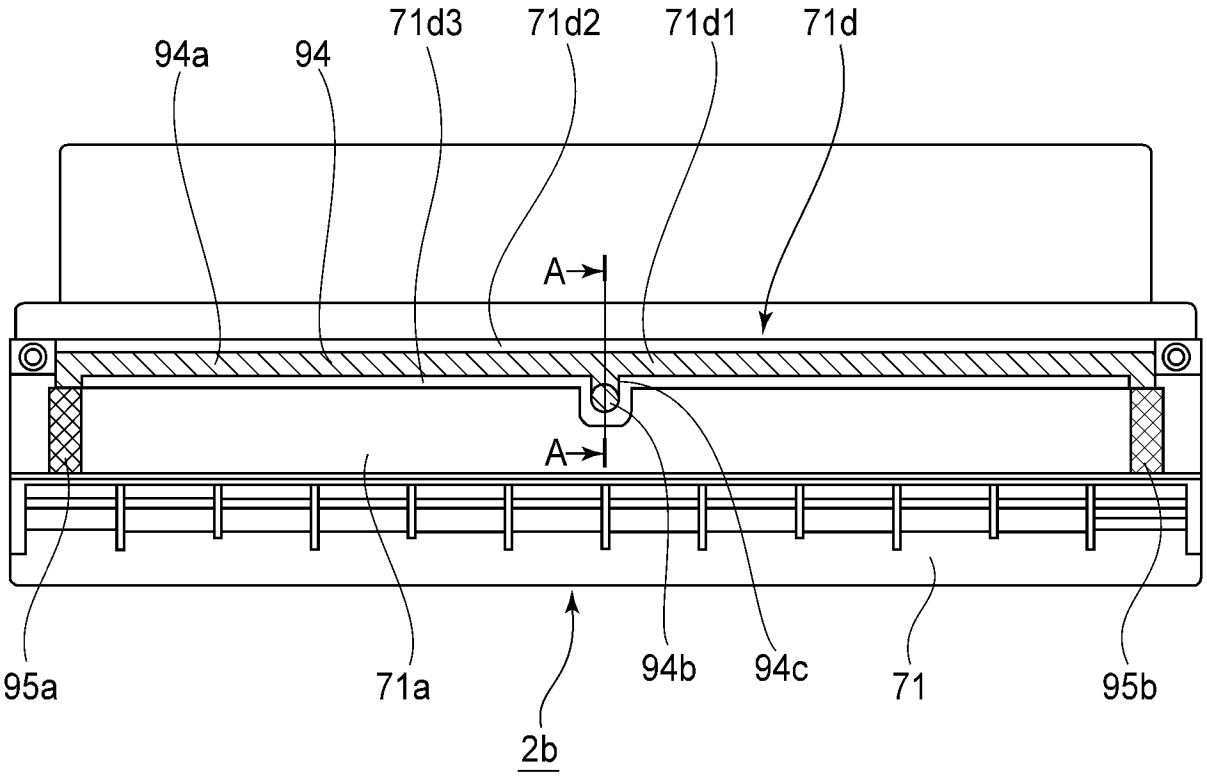
FIG. 5 is a schematic front view after the under-developing-blade seal is molded on the developing frame in Embodiment 1.
Figure 6:
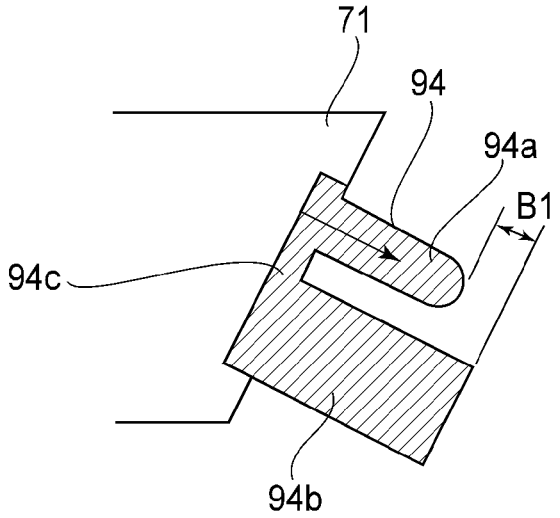
Figure 6:
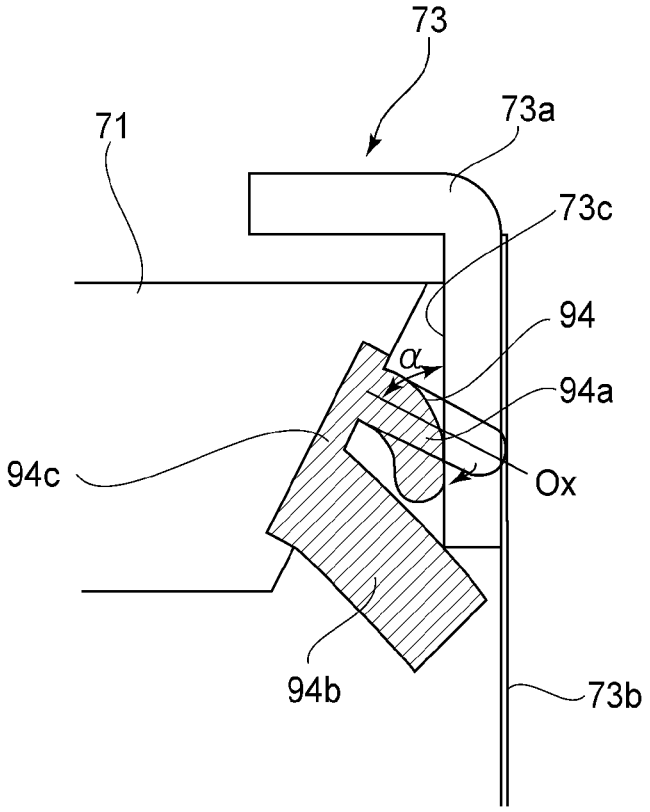

Parts (a) and (b) of FIG. 6 are schematic sectional views of the under-developing-blade seal taken along A-A line indicated in FIG. 5.

Figure 7:
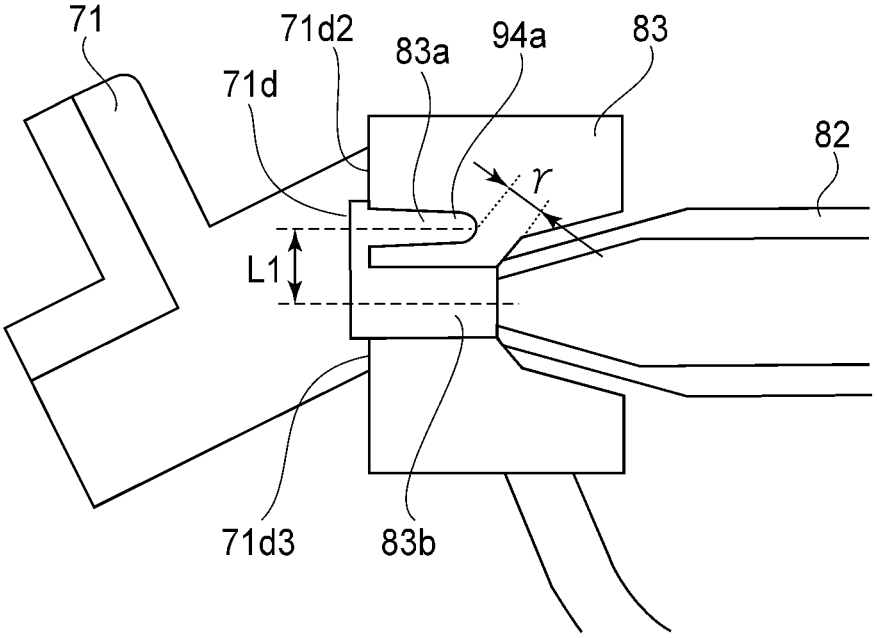

FIG. 7 is a schematic sectional view showing a seal mold of the under-developing-blade seal in Embodiment 1.

Figure 8:
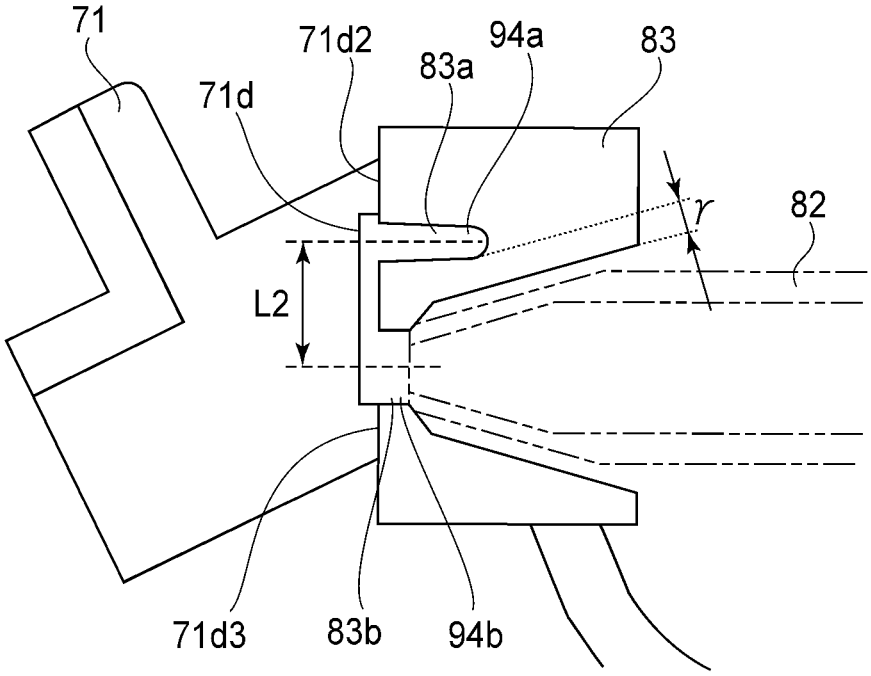

FIG. 8 is a schematic sectional view showing the case where a height of a resin material injecting port is lower than a height of a seal function portion.

Figure 9:
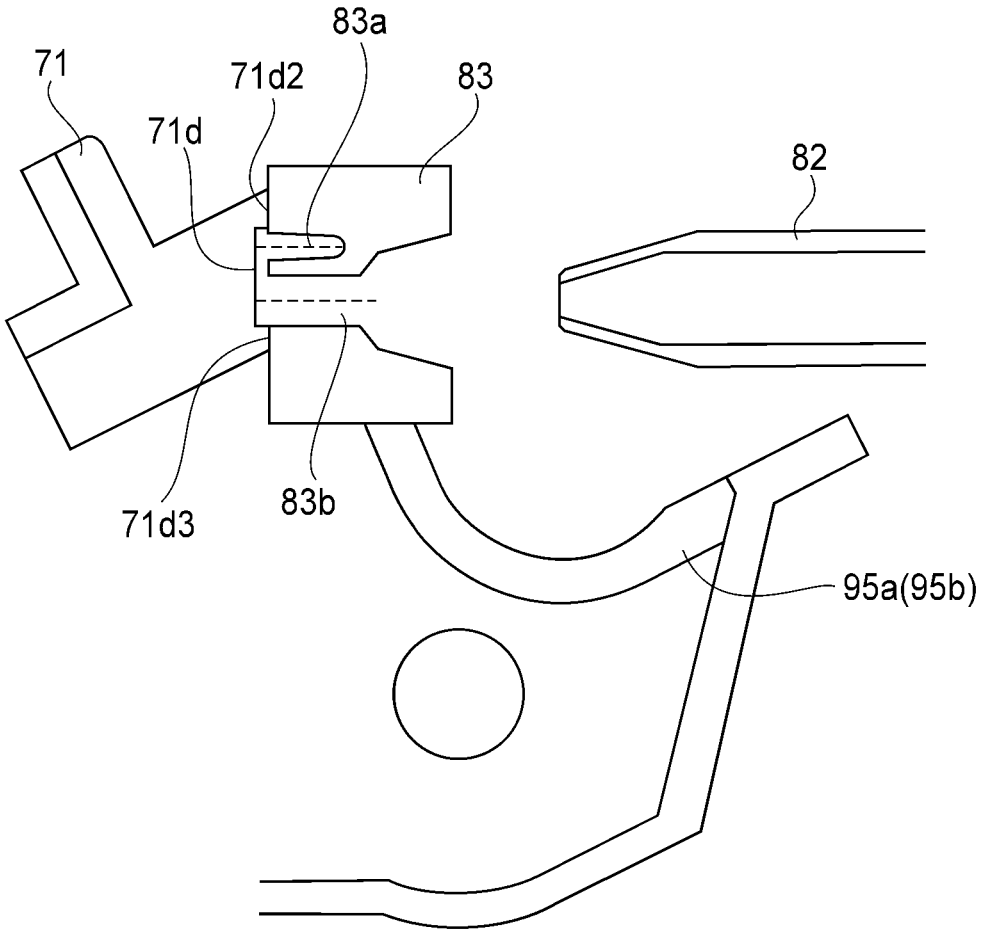

FIG. 9 is a schematic sectional view showing a state in which the seal mold is contacted to the developing frame in Embodiment 1.

Figure 10:
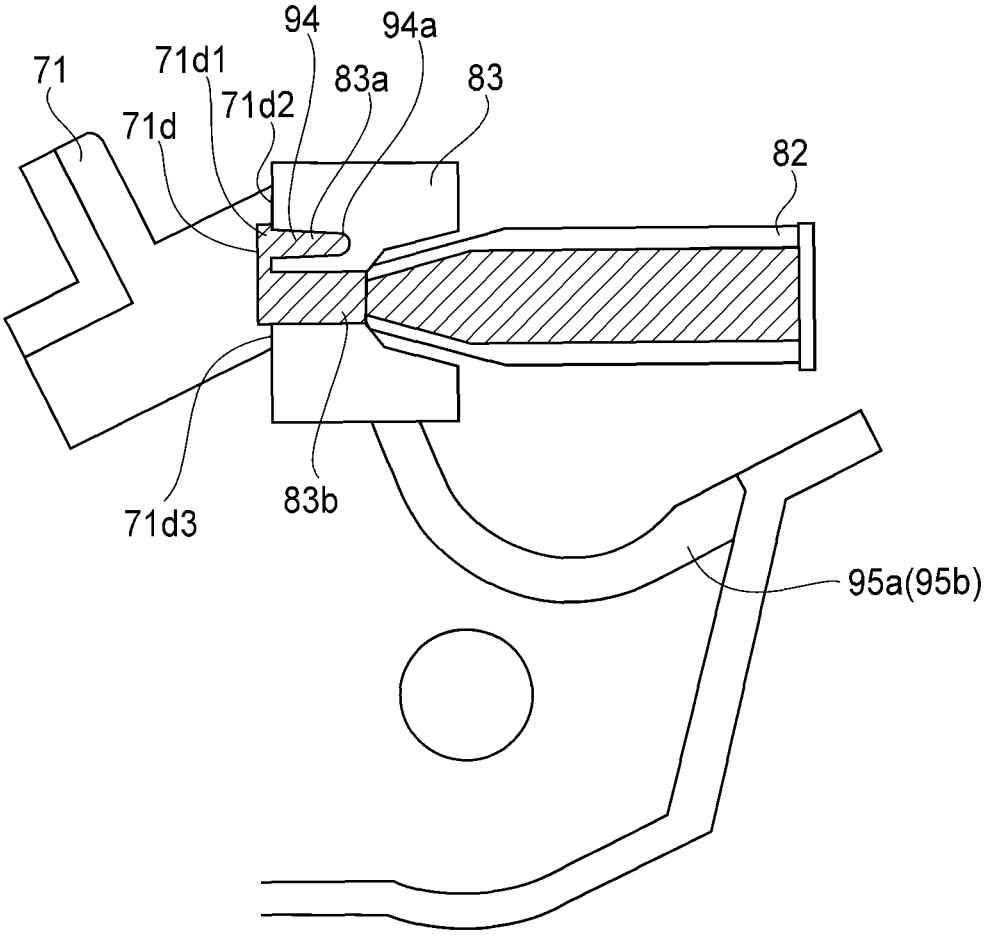

FIG. 10 is a schematic sectional view during mold of the under-developing-blade seal on the developing frame in Embodiment 1.

Figure 11:
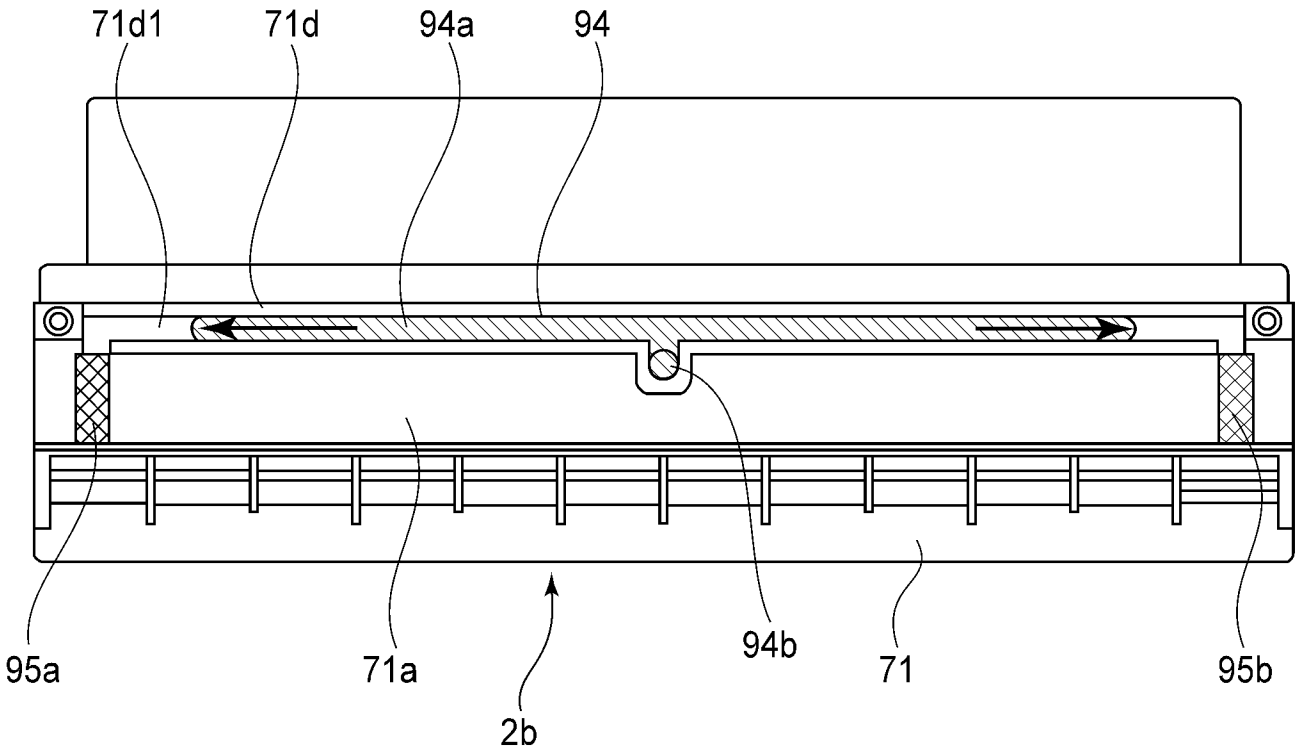

FIG. 11 is a schematic front view during the mold of the under-developing-blade seal on the developing frame in Embodiment 1.

Figure 12:
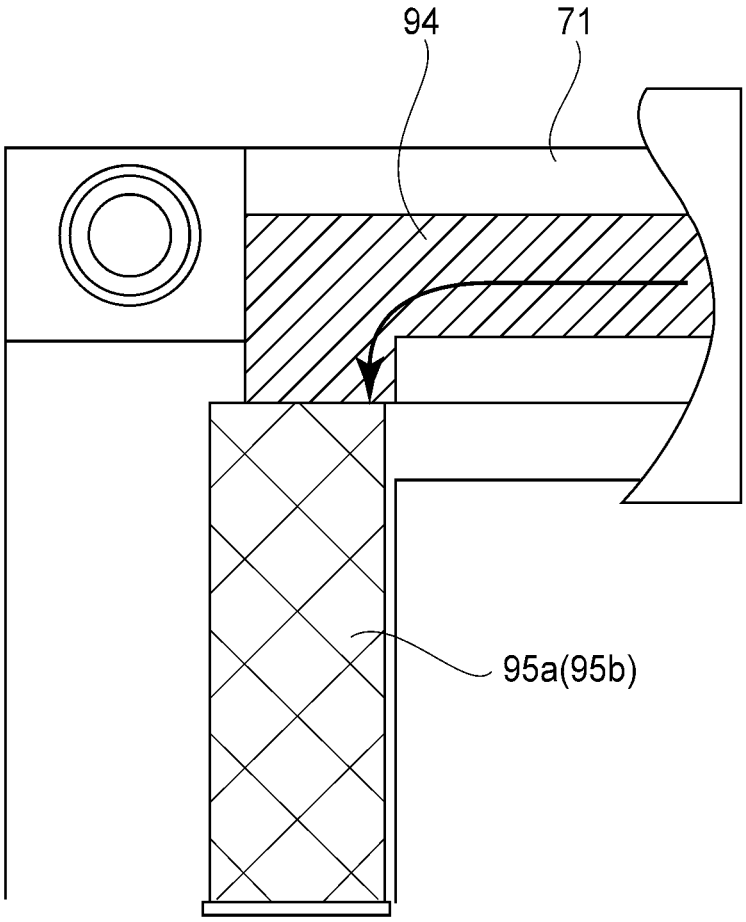

FIG. 12 is a schematic front view of a longitudinal end portion of the developing frame in a state in which the under-developing-blade seal is molded on the developing frame.

Figure 13:
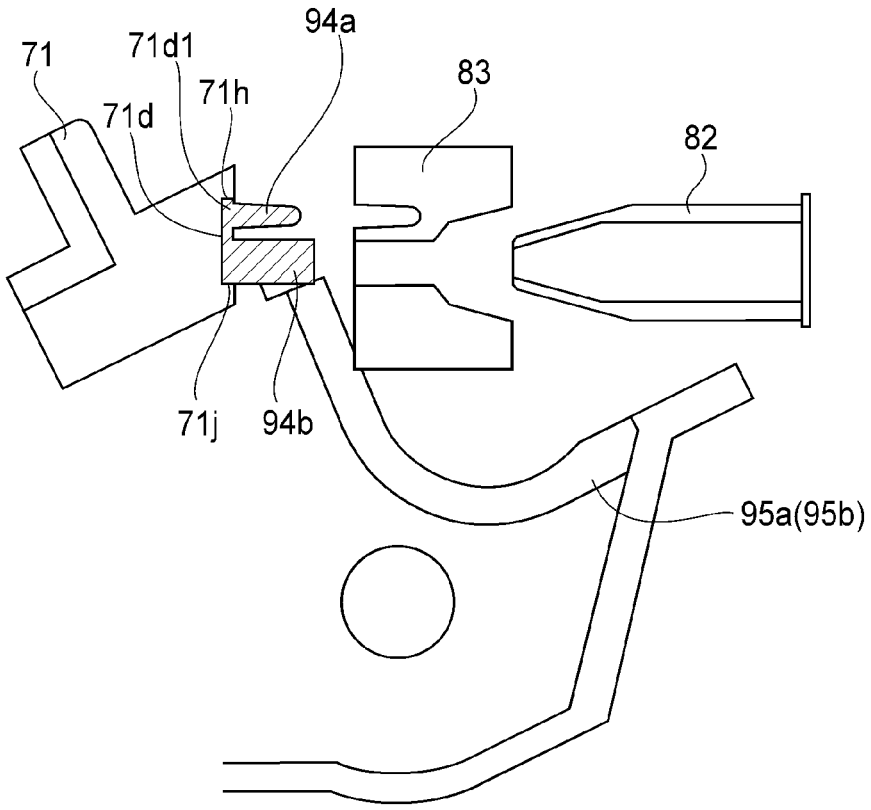

FIG. 13 is a schematic sectional view showing a state in which the seal mold is retracted from the developing frame in Embodiment 1.

Figure 14:
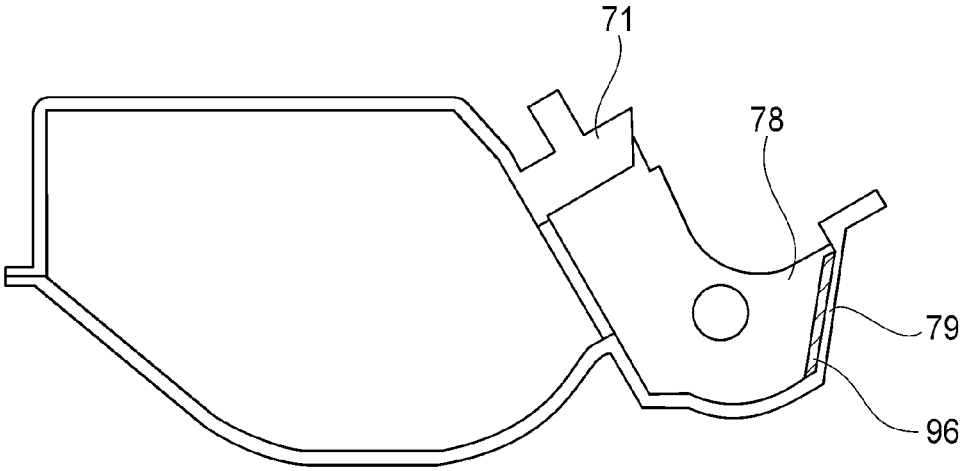

FIG. 14 is a schematic sectional view of a seal structure of a developing frame in Embodiment 2.

Figure 15:
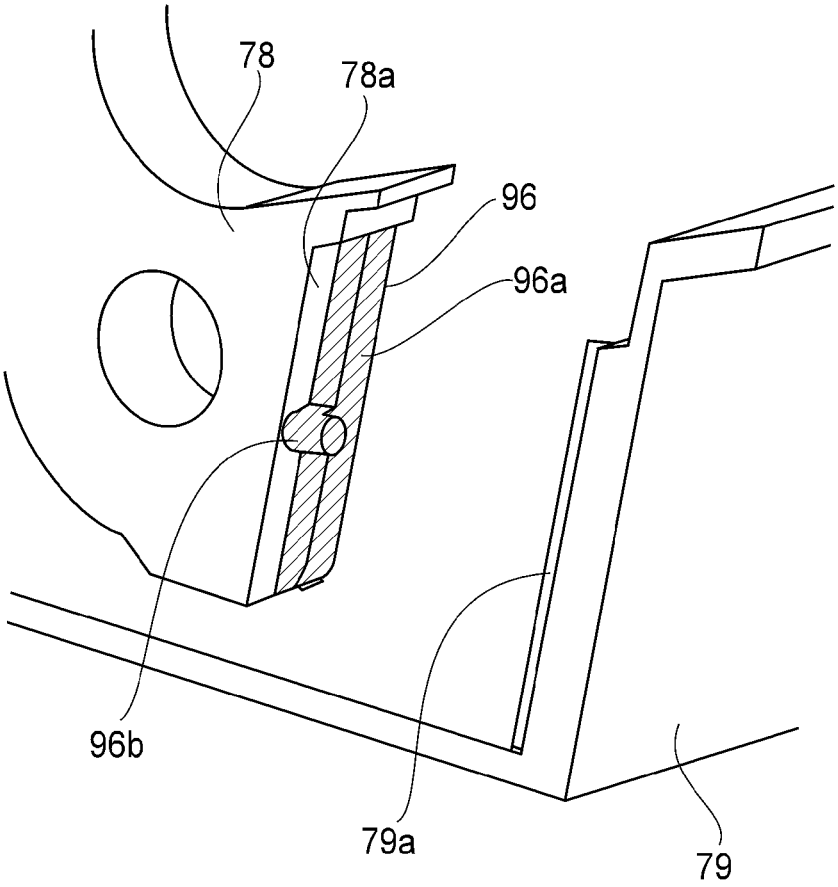

FIG. 15 is a schematic perspective view of the seal structure of the developing frame in Embodiment 2.

Figure 16:
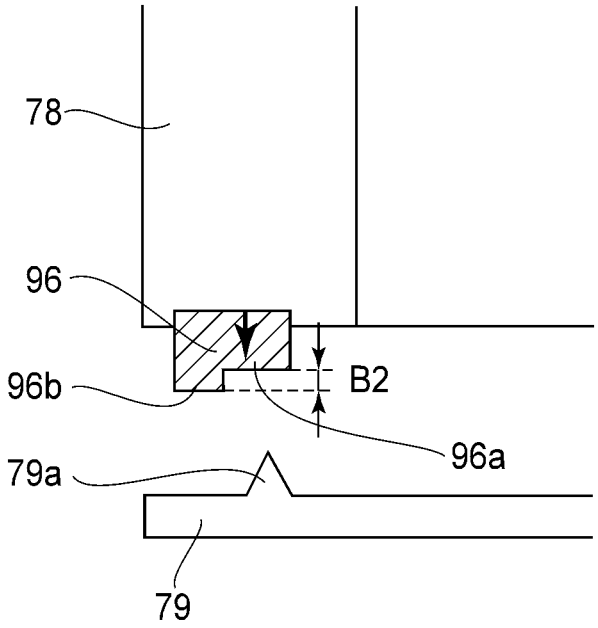
Figure 16:
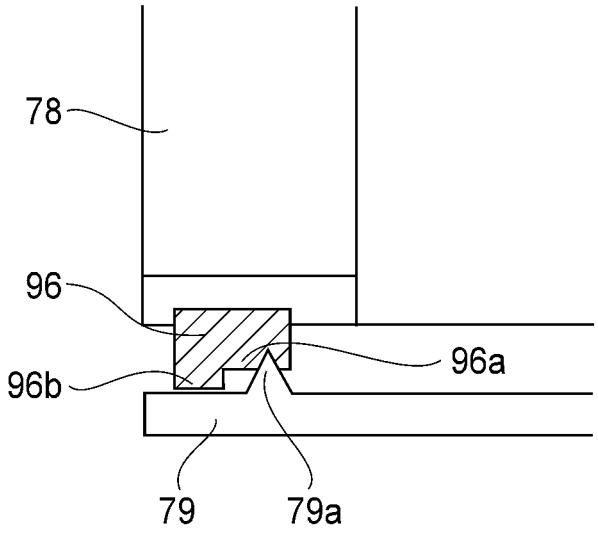

Parts (a) and (b) of FIG. 16 are schematic sectional views of a frame seal portion of the developing frame in Embodiment 2.

DESCRIPTION OF THE PREFERRED EMBODIMENTS

With reference to the drawings, embodiments for carrying out the present invention will be described below. However, dimensions, materials, shapes and relative arrangement of constituent elements described in the following embodiments should be appropriately changed depending on structure and various conditions of devices (apparatuses) to which the present invention is to be applied, and therefore the scope of the present invention is not intended to be limited to the following embodiments.

<Structure of Image Forming Apparatus>

Figure 1:
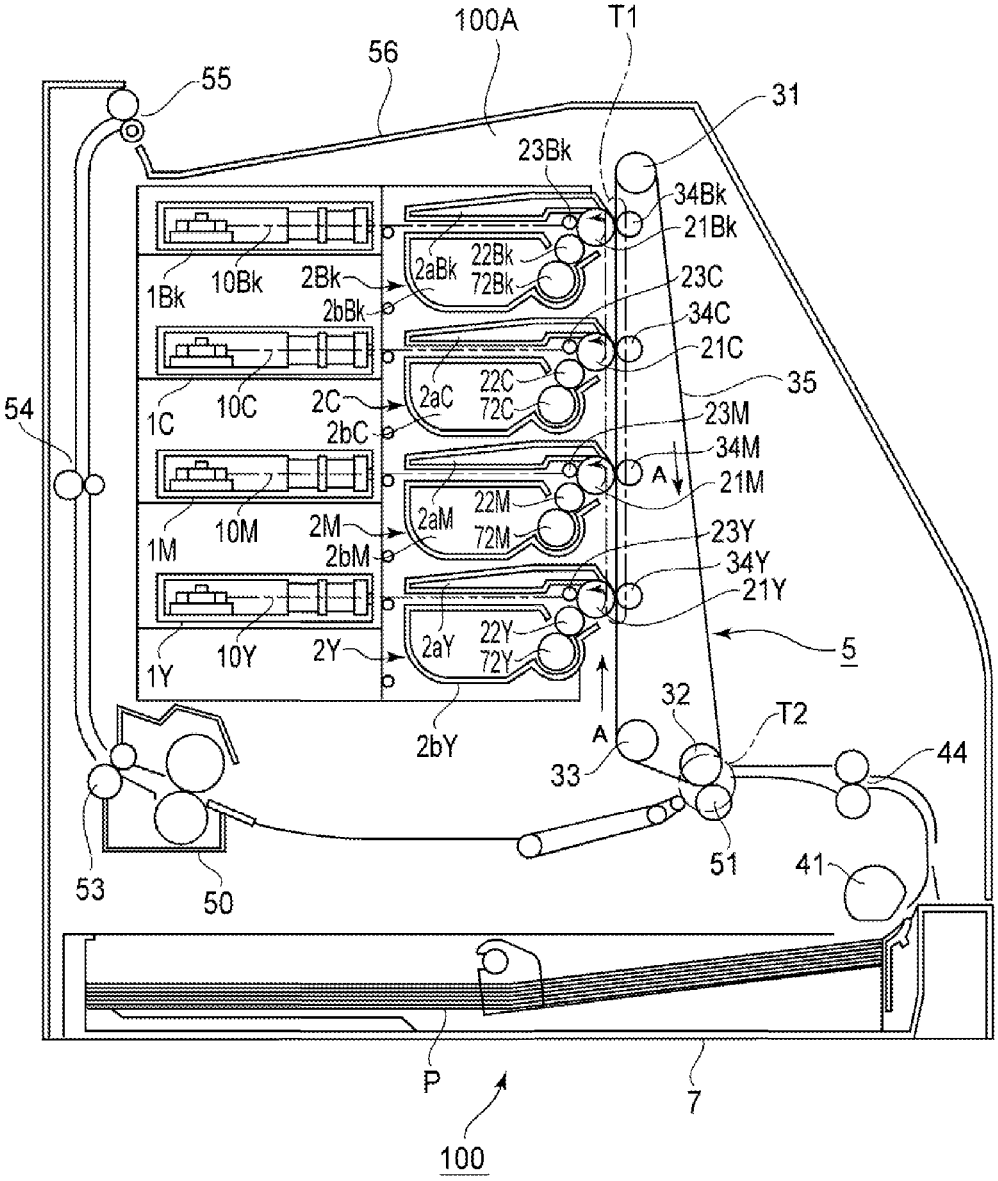
FIG. 1 is a schematic sectional view showing a general structure of a process cartridge in an embodiment.

First, with reference to FIG. 1, a general structure of a laser beam printer as an electrophotographic image forming apparatus 100 in an embodiment of the present invention. FIG. 1 is a schematic sectional view showing the general structure of the image forming apparatus in this embodiment. Incidentally, in the following description, a longitudinal refers to an axial direction (crossing a direction in which a process cartridge 2 is to be mounted in an image forming apparatus main assembly 100A) of a rotation shaft of a photosensitive drum 21.

In this embodiment, as shown in FIG. 1, in the image forming apparatus main assembly 100A, four independent process cartridges 2 (2Y, 2M, 2C, 2Bk) which are detachably mountable to the main assembly 100A are arranged in a vertical direction. The process cartridges 2 (2Y, 2M, 2C, 2Bk) constitute image forming means for toners of yellow (Y), magenta (M), cyan (C) and black (Bk), respectively.

The process cartridges 2 (2Y, 2M, 2C, 2Bk) include rotation drum type electrophotographic photosensitive members (photosensitive drums) 21 (21Y, 21M, 21C, 21Bk), respectively, as an image bearing member. At a periphery of the photosensitive drums 21, charging rollers 23 (23Y, 23M, 23C, 23Bk) as a charging means and developing units 2*b* (2*b*Y, 2*b*M, 2*b*C, 2*b*Bk) each constituting a developing means are provided.

Further, at the periphery of the photosensitive drums 21, cleaning units 2*a* (2*a*Y, 2*a*M, 2*a*C, 2*a*Bk) including cleaning blades 28 (28Y, 28M, 28C, 28Bk), respectively, as a cleaning member are provided. In this way, in this embodiment, each photosensitive drum 21 is, together with the charging roller 23, integrally mounted in the cleaning unit 2*a*. That is, the cleaning unit 2*a* is also a photosensitive drum unit. In other words, in this embodiment, the photosensitive drum unit 2*a* including the photosensitive drum 21, the charging roller 23 and the cleaning blade 28 and the developing unit 2*b* are integrally assembled into a cartridge to form the process cartridge 2 (2Y, 2M, 2C, 2Bk).

The process cartridges 2 (2Y, 2M, 2C, 2Bk) for the four colors are constituted so as to be independently detachably mountable to the image forming apparatus main assembly 100A. Further, developer images (toner images) different in color are successively transferred superposedly onto an intermediary transfer belt 35, as an intermediary transfer member constituting a transfer device 5, by primary transfer rollers 34. As a result, a full-color image is formed on the intermediary transfer belt 35. The intermediary transfer belt 35 is wound around rollers 31, 32 and 33 provided in the transfer device 5, and is provided rotatably in an arrow A direction in FIG. 1. A transfer material P such as paper is fed from a sheet feeding cassette 7 provided at a lower portion of the image forming apparatus main assembly 100A and is conveyed in an upward direction, and then the full-color image on the intermediary transfer belt 35 is collectively transferred onto the transfer material P. Then, the transfer material P is subjected to fixing of the full-color image by a fixing device 50, and thereafter is discharged onto a sheet discharge tray 56 by a group of discharging rollers 53, 54 and 55.

<Image Forming Operation>

Next, an operation in the case where image formation is effected by the above-constituted image forming apparatus will be described. First, a sheet of the transfer material P in the sheet feeding cassette 7 is separated by rotating a sheet feeding roller 41, and is conveyed to a registration roller pair 44. On the other hand, the photosensitive drums 21 and the intermediary transfer belt 35 are rotated at predetermined outer peripheral speeds (process speeds) in directions of arrows in FIG. 1. The surfaces of the photosensitive drums 21 electrically charged uniformly by the charging rollers 23 are exposed to laser beams 10 (10Y, 10M, 10C, 10Bk) from scanner portions as exposure devices 1 (1Y, 1M, 1C, 1Bk). Then, electrostatic latent images are formed on the photosensitive drums 21.

Image forming operations for the respective colors are the same, and therefore in the following, the image forming operation for yellow (Y) will be described. The surface of the photosensitive drum 21Y is irradiated with the laser beam 10Y for an yellow image by the scanner portion 1Y, so that the electrostatic latent image for yellow is formed on the photosensitive drum 21Y. Concurrently with this latent image formation, the electrostatic latent image on the photosensitive drum 21Y is developed with a yellow toner. At the same time, at a primary transfer position T1 downstream of a developing portion, the yellow toner image on the photosensitive drum 21Y is primary-transferred onto an outer peripheral surface of the intermediary transfer belt 35.

Similarly as described above, also with respect to a magenta image, a cyan image and a black image, latent image formation, development and toner image transfer onto the intermediary transfer belt 35 are performed, so that the full-color image consisting of the four types of the toner images of yellow, magenta, cyan and black is formed on the surface of the intermediary transfer belt 35. Concurrently with press-contact with the transfer material P, at a secondary transfer position T2, of the intermediary transfer belt 35 on which the primary transfer of the black toner image for the fourth color is ended and thus the full-color image is formed, a bias is applied to a transfer roller 51. As a result, the four color toner images constituting the full-color image are collectively transferred from the intermediary transfer belt 35 onto the transfer material P at the same time. Thereafter, the transfer material P is separated from the intermediary transfer belt 35 and is conveyed to the fixing device 50. Then, the transfer material P on which the toner image is fixed is discharged onto the discharge tray 56, provided at an upper portion of the main assembly, via the group of discharging rollers (roller pairs) 53, 54 and 55 with an image formation surface downward, so that the image forming operation is ended.

<Structure of Process Cartridge>

Figure 2:
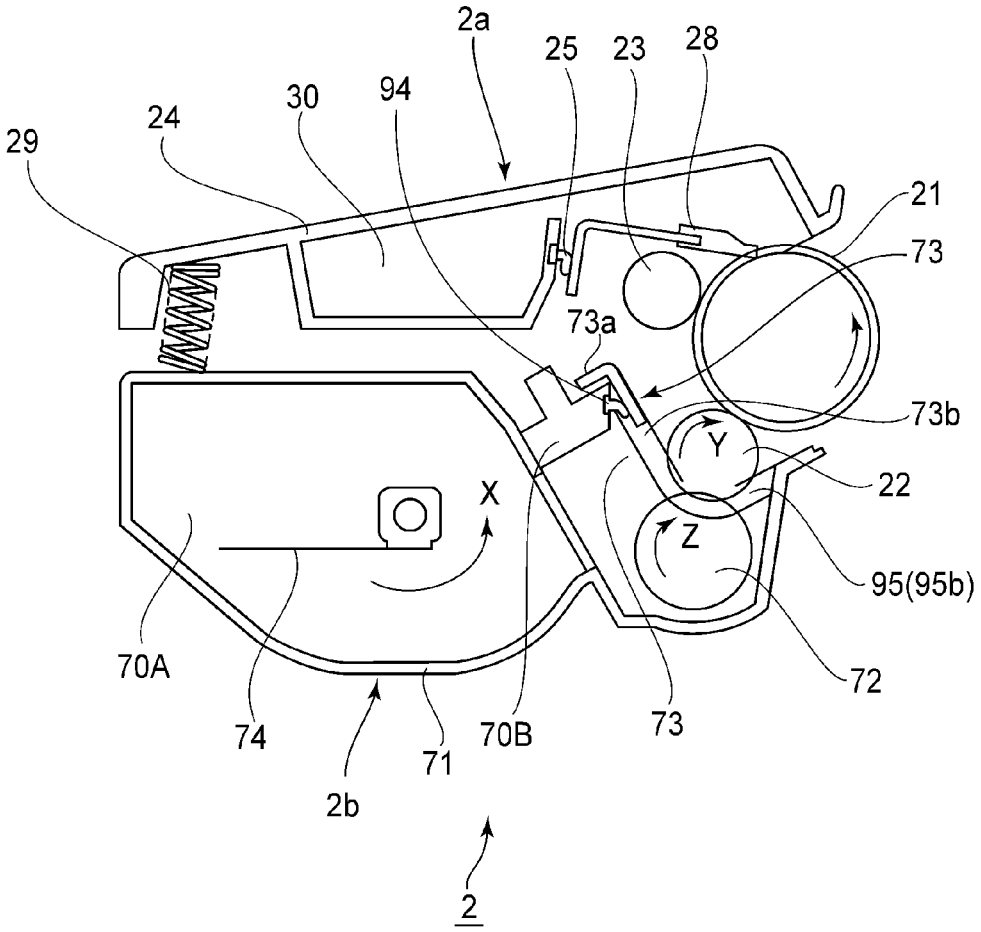
FIG. 2 is a schematic sectional view of the process cartridge in the embodiment.

Next, the process cartridges 2 (2Y, 2M, 2C, 2Bk) in this embodiment will be described with reference to FIG. 2. FIG. 2 is a schematic sectional view of the process cartridge in this embodiment. Incidentally, the process cartridges for the respective colors of yellow, magenta, cyan and black have the same structure. Accordingly, in the following description, suffixes of Y, M, C and Bk for representing the respective colors are omitted, and the process cartridges 2 (2Y, 2M, 2C, 2Bk) for the respective colors will be collectively described as the process cartridge 2.

The process cartridge 2 is, as described above, divided into the cleaning unit, i.e., the photosensitive drum unit 2*a* and the developing unit 2*b*. The photosensitive drum unit 2*a* includes the photosensitive drum 21, the charging roller 23 as the charging means, and the cleaning blade 28 as the cleaning means (member). Further, the developing unit 2*b* is constituted by a developing device (developing means) for developing the electrostatic latent image on the photosensitive drum 21.

Further, in the photosensitive drum unit 2*a*, the photosensitive drum 21 is mounted rotatably on a cleaning frame 24. To the photosensitive drum 21, a driving force is transmitted by an unshown driving motor, so that the photosensitive drum 21 is rotationally driven in the counterclockwise direction in FIG. 2 depending on the image forming operation. Further, on the peripheral surface of the photosensitive drum 21, the charging roller 23 as a primary charging means for electrically charging the surface of the photosensitive drum 21 uniformly and the cleaning blade 28 for removing the developer (toner) remaining on the photosensitive drum (image bearing member) 21 are disposed. The residual toner removed from the surface of the photosensitive drum 21 by the cleaning blade 28 is stored in a residual (waste) toner chamber 30 as an accommodating portion provided at a rear portion of the cleaning frame 24.

The developing unit 2*b* is constituted by a developer accommodating portion 70A as an accommodating portion in which the developer (toner) is accommodated, a developing portion 70*b* where a developing roller 22 as a developer carrying member is rotatably supported, a developing blade unit 73, the developing roller 22, a toner supplying roller 72 and the like. The developer accommodating portion 70A and the developing portion 70B are integrally formed by a developing (device) frame 71 consisting of a plurality of frame members.

The developing roller 22 is rotated in an arrow Y direction in FIG. 2 in contact with the photosensitive drum 21. Further, on a peripheral surface of the developing roller 22, the toner supplying roller 72 rotated in an arrow Z direction in FIG. 2 in contact with the developing roller 22 and the developing blade unit 73 are disposed. The developing roller 22 and the developing blade unit 73 are mounted on the developing frame 71 via end portion seal members 95*a* and 95*b* provided on the developing frame 71 which forms the developing portion 70B and via an under-developing-blade seal (member) 94. As a result, leakage of the toner in the developing portion 70B toward an outside is avoided.

The developing blade unit 73 as a regulating member includes a developing blade 73*b* for regulating an amount of the toner on the developing roller 22 and includes a supporting plate 73*a* for supporting the developing blade 73*b*, and is mounted on the developing frame 71. Details of the developing blade unit 73 will be described later.

Inside the developer accommodating portion 70A, a toner stirring mechanism 74 for stirring the accommodated toner and for feeding the toner to the toner supplying roller 72 is provided. Further, the developing unit 2*b* is urged by an urging spring 29 so that the developing roller 22 contacts the photosensitive drum 21. During the development, the accommodated toner is fed to the toner supplying roller 72 by the toner stirring mechanism 74 rotationally driven in an arrow X direction. As a result, the toner supplying roller 72 rotated in the arrow Z direction supplies the toner to the developing roller 22 by friction with the developing roller 22 rotated in the arrow Y direction. The toner carried on the developing roller (developer carrying member) 22 reaches the developing blade unit 73 with the rotation of the developing roller 22, and the developing blade unit 73 regulates the toner to impart a desired amount of electric charges to the toner, and at the same time, a layer thickness of the toner is regulated. The regulated toner is conveyed to the developing portion, where the photosensitive drum 21 and the developing roller 22 contact each other, with the rotation of the developing roller 22, and then is transferred onto the surface of the photosensitive drum 21 by a DC developing bias applied, at the developing portion, from an unshown power source to the developing roller 22.

Embodiment 1

Seal Structure of Developing Unit

Next, with reference to FIGS. 3 to 7, a seal structure of the developing unit 2*b* in Embodiment 1 will be described.

Figure 3:
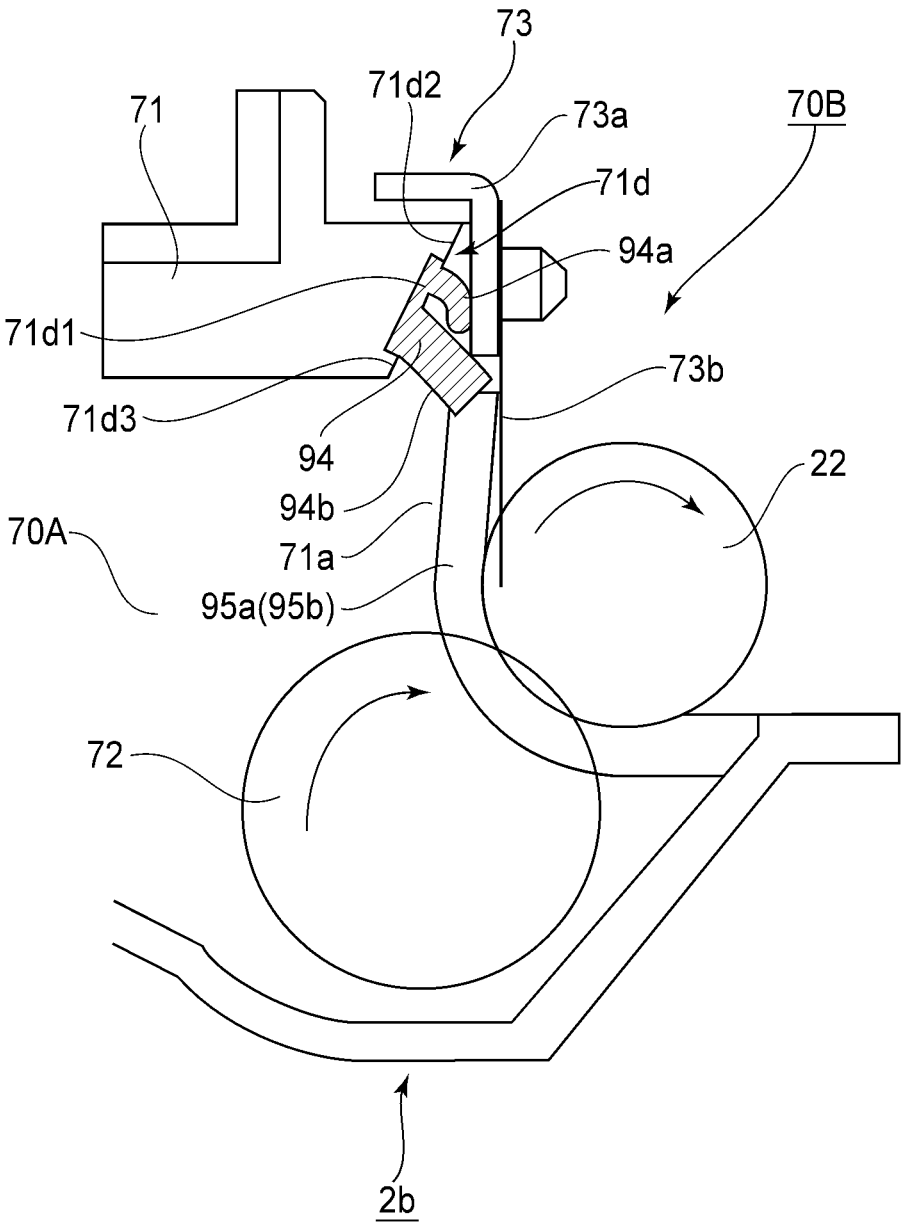
FIG. 3 is a schematic sectional view showing a seal structure of a developing unit in Embodiment 1.
Figure 4:
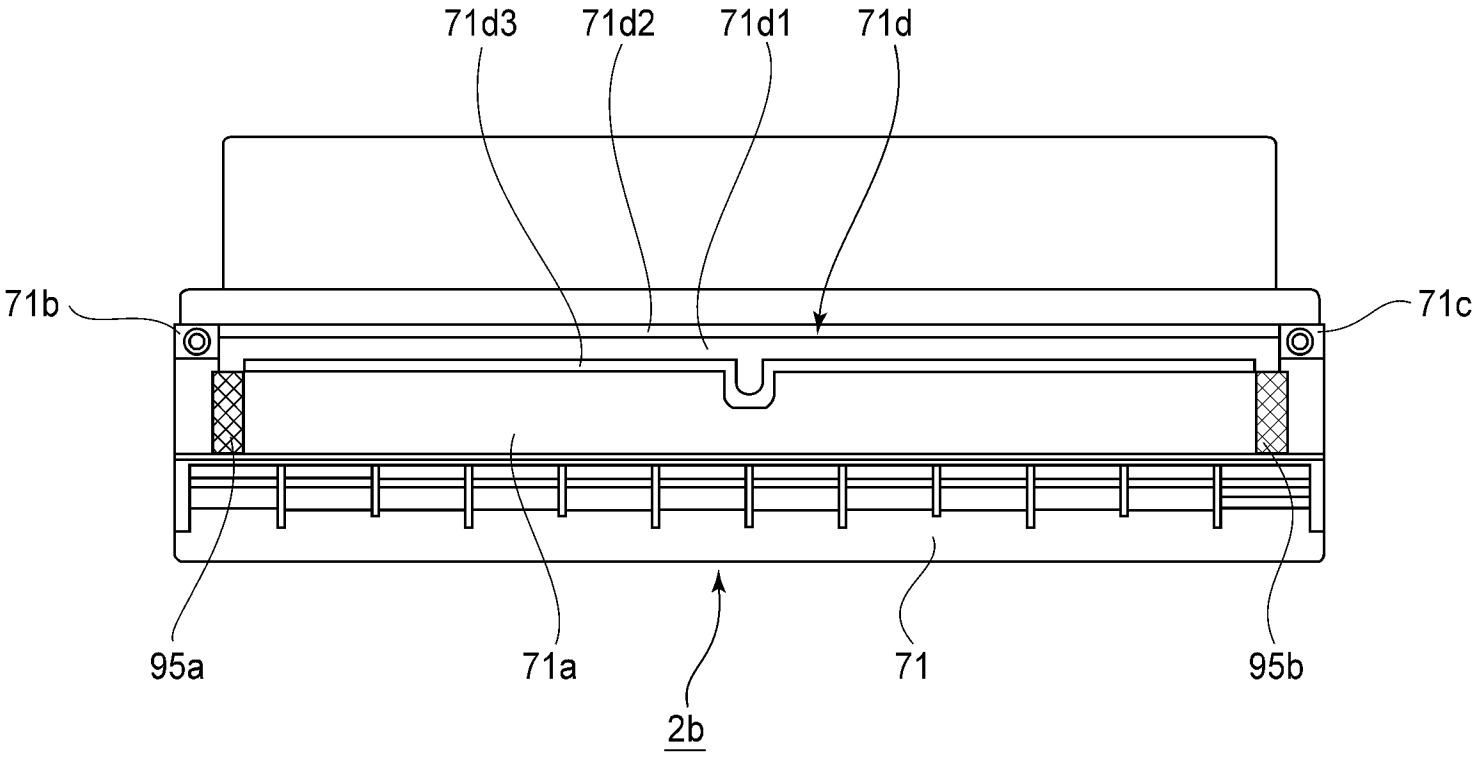
FIG. 4 is a schematic front view before a under-developing-blade seal is molded on a developing (device) frame in Embodiment 1.

FIG. 3 is a schematic sectional view showing a seal structure of a developing unit in this embodiment. FIG. 4 is a schematic front view before a under-developing-blade seal is molded on a developing (device) frame in this embodiment. FIG. 5 is a schematic front view after the under-developing-blade seal is molded on the developing frame in this embodiment. Parts (a) and (b) of FIG. 6 are schematic sectional views of the under-developing-blade seal taken along A-A line indicated in Embodiment 5, wherein (a) of FIG. 6 shows a state before the developing blade unit is connected, and (b) of FIG. 6 shows a state in which the developing blade unit is connected. FIG. 7 is a schematic sectional view showing a seal mold of the under-developing-blade seal in this embodiment.

As shown in FIG. 3, the developing portion 70B includes a developing opening 71*a* for permitting supply of the toner, accommodated in the toner accommodating portion 70A as the accommodating portion, to the developing roller 22. Further, the developing roller 22 and the developing blade unit 73 as a regulating member (connected member) for regulating the layer thickness of the toner on the developing roller 22 and disposed in the neighborhood of the developing opening 71*a*.

The developing blade unit 73 in this embodiment is constituted by connecting the developing blade 73*b*, formed with a stainless steel plate or a phosphor bronze plate, with the supporting plate 73*a* formed of a steel plate. The supporting plate 73*a* is locked and supported, by screws or the like, at locking portions (FIG. 4) provided at end portions of the developing frame 71. Incidentally, the developing blade 73*b* may also be prepared by integrally molding a rubber or the like with the supporting plate 73*a*.

As shown in FIGS. 3 to 5, at longitudinal end portions of the developing opening 71*a*, the end portion seal members 95*a* and 95*b* for sealing a gap between the developing frame 71 and the peripheral surface of the developing roller 22 are disposed. The end portion seal members 95*a* and 95*b* are a flexible member formed with a pile of felt or fibers which are surface-woven, or electrostatically planted fibers, or the like. When the developing roller 22 and the developing blade unit 73 are mounted on the developing frame 71, the peripheral surface of the developing roller 22 and the back surface of the developing blade 73*b* of the developing blade unit 73 are press-contacted to each other. As a result, in the developing unit 2*b*, a sealing property of the developing roller 22 with respect to an axial direction is maintained by the end portion seal members 95*a* and 95*b*.

At an upper portion of the developing opening 71*a*, on the developing frame 71, a seal forming portion 71*d* is provided between the end portion seal member 95*a* in a side and the end portion seal member 95*b* in another side over a longitudinal direction of the developing frame 71. The seal forming portion 71*d* includes a recessed portion 71*d*1 into which a resin material as a material for sealing is to be injected, and contact surfaces 71*d*2 and 71*d*3 to which a mold is to be contacted. As shown in FIG. 5, the under-developing-blade seal 94 as an elastic member (seal member) is provided at the recessed portion 71*d* of the seal forming portion 71*d* of the developing frame 71. The under-developing-blade seal 94 includes a seal function portion 94*a* as the seal portion and a sprue (gate portion) 94*b* as an injected resin portion or a molded portion.

As shown in (a) and (b) of FIG. 6, the sprue 94*b* is formed, closely to the seal function portion 94*a*, so as to be projected in a position different from the seal function portion 94*a*. Further, the seal function portion 94*a* and the sprue 94*b* are connected, at lower portions thereof, by a connecting portion 94*c*. Further, as shown in (b) of FIG. 6, the seal function portion 94*a* of the under-developing-blade seal 94 is provided in contact with the developing blade unit 73. That is, the seal function portion 94*a* has a function of maintaining a sealing property so as to prevent the toner from being leaked out from between the developing frame 71 and the developing blade unit 73. Further, as shown in FIG. 5, the under-developing-blade seal 94 is constituted to seal a region between the end portion seal member 95*a* in the (one) side and the end portion seal member 95*b* in another side so as to prevent the leakage of the toner while being hermetically contacted to the recessed portion 71*d*1 with no gap.

As shown in (b) of FIG. 6, a cross-sectional shape of the seal function portion 94*a* of the under-developing-blade seal 94 is a projected shape (lip shape) such that a center axis Ox thereof is inclined by an angle $\alpha$ from a seal contact surface 73*c* of the developing blade unit 73.

On the other hand, as shown in (b) of FIG. 6, the sprue 94*b* is provided, more than the seal function portion 94*a* in an end portion side of the developing blade unit 73 with respect to a direction (widthwise direction) perpendicular to a longitudinal direction. Further, the sprue 94*b* is provided in a projected state so that an end portion thereof is not compressed by the developing blade unit 73. Specifically, the sprue 94*b* is formed and projected substantially in the same direction as a direction (arrow direction in (a) of FIG. 6) in which the seal function portion 94*a* is projected in the projected shape from the developing frame. Further, the sprue 94*b* has a shape such that the sprue 94*b* is higher than the seal function portion 94*a* by a width B1 shown in (a) of FIG. 6 with respect to the direction in which the seal function portion 94*a* is projected in the projected shape. Further, the sprue 94*b* is disposed in a side (inside the developing frame 71), more than the seal function portion 94*a*, in which the toner is accommodated in the developing frame 71, and the sprue 94*b* is provided closely to the seal function portion 94*a*.

As described above, in this embodiment, by forming the sprue 94*b* so as to be higher than the seal function portion 94*a*, it becomes possible to dispose the sprue 94*b* closely to the seal function portion 94*a*. When the under-developing-blade seal 94 is subjected to the injection molding, as shown in FIG. 7, there is a need to provide a seal mold 83 as the mold with a shape for permitting contact of a gate 82 of a resin material injecting device. Also in such a constitution, there is a need to ensure a thickness $\gamma$ necessary to ensure strength of the seal mold 83. In this embodiment, the height of the sprue 94*b* is made higher than the height of the seal function portion 94*a*, whereby it is possible to ensure the thickness ($\gamma$ in FIG. 7) necessary to ensure the strength of the seal mold 83.

For comparison, the case where the height of the sprue 94*b* of the under-developing-blade seal 94 with respect to the projection direction is set so as to be lower than the seal function portion 94*a* is shown in FIG. 8. As shown in FIG. 8, in order to ensure the thickness $\gamma$ of the seal mold 83 for ensuring necessary strength of the seal mold 83, it is understood that a distance L2 between the sprue 94*b* and the seal function portion 94*a* is required to be ensured so as to be larger than a distance L1 (FIG. 7). That is, in the case where the height of the sprue 94*b* is set so as to be lower than the seal function portion 94*a*, an increase in size of the under-developing-blade seal 94 is invited.

Further, in the constitution in this embodiment, the sprue 94*b* is not provided on the seal function portion 94*a*, and therefore at a contact portion of the seal function portion 94*a* with the developing blade unit 73, a stepped portion between the seal function portion 94*a* and the sprue 94*b* is not formed, so that the sealing property is maintained with reliability. Further, in a state in which the developing blade unit 73 is mounted on the developing frame 71, as shown in (b) of FIG. 6, the under-developing-blade seal 94 is deformed so as to be flexed in contact with the developing blade unit 73. At this time, also the sprue 94*b* is deformed so as to be flexed in the same direction by the developing blade unit 73. That is, the sprue 94*b* is deformed in the same direction as the seal function portion 94*a*, and therefore the sprue 94*b* is in a state in which the sprue 94*b* is not readily contacted to the seal function portion 94*a*, so that the sealing property (contact state) of the seal function portion 94*a* is not adversely affected. Further, also the sprue 94*b* is deformed so as to be flexed, so that a degree of the influence of a repelling force on the developing blade unit 73 is very small when compared with the case of compression deformation. Further, also a degree of an increase in contact force is very small, and therefore there is substantially no influence on the regulation of the layer thickness of the toner on the developing roller 22.

In this embodiment, the under-developing-blade seal 94 is formed integrally with the developing frame 71 by subjecting an elastic seal material to injection molding on the developing frame 71. In this embodiment, as the material (elastic seal material) for the under-developing-blade seal 94, an elastomer resin material is used. As the elastomer resin material, a styrene-based elastomer resin material which is the same material as the developing frame 71 and which has elasticity may preferably be used since the styrene-based elastomer resin material is excellent in a disassembling operation property of the process cartridge during recycling. This is because when parts of the process cartridge are formed of the same material, there is no need to effect disassembling between the parts. However, even when another elastomer resin material other than the above-described material is used, the elastomer material may only be required to have a similar mechanism characteristic, and it is also possible to use a silicone-based rubber, a soft rubber or the like. Accordingly, in this embodiment, materials including the above-described various elastomer resin materials, rubbers and the like as the elastic seal material are referred collectively as the "elastomer resin material".

<Seal Molding Step>

Here, with reference to FIGS. 9 to 13, a step of molding the under-developing-blade seal 94 in this embodiment will be described. FIG. 9 is a schematic sectional view showing a state in which the seal mold is contacted to the developing frame in this embodiment. FIG. 10 is a schematic sectional view during mold of the under-developing-blade seal on the developing frame in this embodiment. FIG. 11 is a schematic front view during the mold of the under-developing-blade seal on the developing frame in this embodiment. FIG. 12 is a schematic front view of a longitudinal end portion of the developing frame in a state in which the under-developing-blade seal is molded on the developing frame in this embodiment. FIG. 13 is a schematic sectional view showing a state in which the seal mold is retracted from the developing frame in this embodiment.

First, the end portion seal members 95*a* and 95*b* are assembled with the developing frame 71 in longitudinal sides, respectively. Next, as shown in FIG. 9, the seal mold 83 as the mold provided with the seal shape is contacted to the contact surfaces 71*d*2 and 71*d*3 of the seal forming portion 71*d* of the developing frame 71. Then, the gate 82 of the resin material injecting device is contacted to a sprue-forming portion (injecting port) 83*b* (FIGS. 7-10) provided at a longitudinal central portion of the seal mold 83. The sprue 94*b* as the molded portion is to be formed correspondingly to a shape of the sprue-forming portion 83*b*. Here, the resin material injecting port 94*b* of the under-developing-blade seal 94 has the shape such that the resin material injecting port 94*b* is projected so as to be higher than the seal function portion 94*a*. For that reason, it is possible to ensure a space in which the gate 82 of the resin material injecting device enters and contacts the seal mold 83 without communicating with a seal function portion-forming portion 83*a*, of the seal mold 83, where the seal function portion 94*a* is to be formed.

Next, as shown in FIG. 10, the gate 82 of the resin material injecting device is contacted to the seal mold 83, and then the elastomer resin material as the seal material for the under-developing-blade seal 94 is injected from the gate 82 of the resin material injecting device into the sprue-forming portion 83*b*. The elastomer resin material flows from the sprue-forming portion 83*b* toward the seal function portion-forming portion 83*a* of the seal mold 83.

Then, the injected elastomer resin material flows, as shown in FIG. 11, toward each of the longitudinal end sides in a space formed by the recessed portion 71*d*1 of the seal forming portion 71*d* and the seal function portion-forming portion 83*a* of the seal mold 83. The elastomer resin material flowed in the longitudinal direction reaches, as shown in FIG. 12, the end portion seal member 95*a* (95*b*) provided at the longitudinal end portion, and is sufficiently connected (contacted) to the end portion seal member 95*a* (95*b*) with no gap.

Then, after the injection of the elastomer resin material is ended, the developing frame 71 and the seal mold 83 are retracted from the gate 82. Next, the seal mold 83 is retracted from the developing frame 71. As shown in FIG. 13, when the seal mold 83 is retracted from the developing frame 71, on the developing frame 71, the seal function portion-forming portion 83*a* and the sprue 94*b* of the under-developing-blade seal 94 are formed. The sprue 94*b* is formed in the shape such that the sprue 94*b* is projected so as to be higher than the seal function portion 94*a*. When the seal mold 83 is retracted from the developing frame 71, a close contact force acting on between the under-developing-blade seal 94 and surfaces 71*h* and 71*j* which form the recessed portion 71*d*1 of the seal forming portion 71*d* generates reaction in a shearing direction with respect to the retraction direction of the seal mold 83. For that reason, the under-developing-blade seal 94 remains in the developing frame 71 side and is not moved toward the seal mold 83 side while being adhered to the seal mold 83, so that a state in which the under-developing-blade seal 94 is formed with reliably at the seal forming portion 71*d* of the developing frame 71 is created.

As described above, in this embodiment, by employing the constitution in which the sprue 94*b* is projected in the projection direction in a degree larger than that of the seal function portion 94*a*, it is possible to improve the sealing property while suppressing the increase in size of the under-developing-blade seal 94. Further, the sprue 94*b* is provided in the position different from the position of the seal function portion 94*a*, so that it is possible to maintain the sealing property without forming an uneven portion at the seal function portion 94*a*.

Embodiment 2

Next, Embodiment 2 will be described with reference to FIGS. 14 to 16. FIG. 14 is a schematic sectional view of a seal structure of a developing frame in this embodiment. FIG. 15 is a schematic perspective view of the seal structure of the developing frame in this embodiment. Parts (a) and (b) of FIG. 16 are schematic sectional views of a frame seal portion of the developing frame in this embodiment, wherein (a) shows a state before a developing frame member is connected, and (b) shows a state in which the developing frame member is connected. In this embodiment, a frame seal 96 as a seal member for sealing between developing frame members 78 and 79 each being a part of the developing frame 71 is formed of the elastomer resin material.

As shown in FIGS. 14 and 15, the frame seal 96 includes a seal function portion 96*a* as the seal portion and a sprue 96*b* as the molded portion. The seal function portion 96*a* is formed at a seal forming portion 78*a* of the developing frame member 78 by injection molding, and is projected in a projected shape from the seal forming portion 78*a*. Further, the seal function portion 96*a* has a planar shape at the surface thereof. The sprue 96*b* is formed so as to be projected in a position different from a position of the seal function portion 96*a* and is connected to the seal function portion 96*a*.

Further, as shown in FIG. 15 and (a) of FIG. 16, the sprue 96*b* is formed and projected in the same direction as a direction (arrow direction in (a) of FIG. 16) in which the seal function portion 96*a* is projected in the projected shape from the seal forming portion 78*a* of the developing frame member 78. Further, in this embodiment, the sprue 96*b* is formed so as to be higher than the seal function portion 96*a* by a height B2 shown in (a) of FIG. 16 with respect to the projection direction.

Here, in this embodiment, the developing frame member 79 as a connected member includes a projected portion 79*a* as a projection projected so as to compress the seal function portion 96*a* between the projected portion 79*a* and the developing frame member 78. The projected portion 79*a* is disposed opposed to the seal function portion 96*a* of the frame seal 96 formed on the developing frame member 78. Then, in connection between the developing frame members 78 and 79, as shown in (b) of FIG. 16, the projected portion 79*a* of the developing frame member 79 contacts the seal function portion 96*a* of the frame seal 96. As a result, a sealing property between the developing frame members 78 and 79 is maintained.

Further, at a portion where the seal function portion 96*a* contacts the developing frame member 79, a stepped portion between the seal function portion 96*a* and the sprue 96*b* is not formed, and therefore the sealing property is maintained. Further, between the developing frame members 78 and 79 which are molded by using the resin material, it is easy to form a shape such that the sprue 96*b* does not contact the developing frame member 79. For that reason, even when the seal function portion 96*a* has a planar shape, it is possible to provide a constitution in which a repelling force of the frame seal 96 generated by contact with the projected portion 79*a* of the developing frame member 79 does not readily influence on the developing frame member 79.

Even when a constitution in which the surface of the seal function portion 96*a* is flush with the surface of the sprue 96*b* is employed, the frame seal 96 is in contact with the projected portion 79*b* of the developing frame member 79 in a state the projected portion 79*b* bites into the seal function portion 96*a*, and therefore the sealing property is not impaired due to the influence of deformation of the sprue 96*b* on deformation of the seal function portion 96*a*. Further, a seal molding step is similarly performed as described above, and therefore the frame seal 96 is formed on the developing frame member 78 with reliability.

Embodiment 3

Next, Embodiment 3 will be described. In Embodiment 1, the under-developing-blade seal 94 of the developing unit 2*b* shown in FIG. 2 was described, but the present invention is also applicable to a under-cleaning-blade seal 25 of the photosensitive drum unit (cleaning unit) 2*a*. That is, the under-cleaning-blade seal 25 as a seal member provided between the cleaning frame 24 and a cleaning blade 28 as a connected member connected with the cleaning frame 24 has the following constitution.

The under-cleaning-blade seal 25 is formed by bringing a mold into contact with the cleaning frame 24 and then by injecting the resin material onto the mold. The under-cleaning-blade seal 25 includes a seal function portion as a seal portion and a sprue as a molded portion. By providing such a under-cleaning-blade seal 25, it is possible to prevent the toner from leaking out from between the cleaning frame 24 and the cleaning blade 28.

In the process cartridge 2 including the under-cleaning-blade seal 25 in this embodiment, an effect similar to the effect in Embodiment 1 can be obtained. That is, in this embodiment, by employing a constitution in which the sprue of the under-cleaning-blade seal 25 is projected in the projection direction in a degree larger than that of the seal function portion, it is possible to improve the sealing property while suppressing an increase in size of the under-cleaning-blade seal 25. Further, the sprue is provided in a position different from a position of the seal function portion, and therefore an uneven portion is not formed on the seal function portion, so that it is possible to maintain the sealing property.

Incidentally, the constitution in the above-described embodiments can be employed in a combined manner to the possible extent.

According to the present invention, it is possible to improve the sealing property while suppressing the increase in size of the seal member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 219773/2012 filed Oct. 1, 2012, which is hereby incorporated by reference.

What is claimed is:

1. A cartridge detachably mountable to a main assembly of an image forming apparatus, said cartridge comprising:

a frame;

an accommodating portion, constituted by said frame, for accommodating developer;

a seal portion for preventing the developer from being leaked out from said accommodating portion, wherein said seal portion is formed by injection molding at a seal forming portion provided on said frame and is projected from said seal forming portion; and a sprue which is formed integrally with said seal portion by a resin material remaining in a path for permitting flow of the resin material melted when said seal portion is formed by the injection molding and which is projected from a surface of said frame at a position different from a position of said seal portion such that said sprue projects further in a direction perpendicular to said surface than said seal portion projects in the direction perpendicular to said surface.

2. A cartridge according to claim 1, wherein said sprue is provided at the position different from the position of said seal portion with respect to a direction perpendicular to a longitudinal direction of said seal portion.

3. A cartridge according to claim 1, wherein said seal portion is provided inside said accommodating portion.

4. A cartridge according to claim 1, wherein said seal portion is inclined and projected from said seal forming portion.

5. A cartridge according to claim 1, wherein said sprue is inclined and projected from said seal forming portion.

6. A cartridge according to claim 1, wherein said seal portion and said sprue are close to each other with respect to a direction perpendicular to a longitudinal direction of said seal portion.

7. A cartridge according to claim 1, wherein said seal portion is formed of an elastically deformable elastomer resin material.

8. A cartridge according to claim 1, further comprising a connected member to be connected to said frame to constitute said accommodating portion and contactable to said seal portion.

9. A cartridge according to claim 8, wherein said sprue is provided in a noncontact position with said connected member.

10. A cartridge according to claim 8, wherein said seal portion and said sprue are in noncontact with each other in a state in which said connected member is mounted on said frame.

11. A cartridge according to claim 8, wherein between said seal portion and said sprue a groove is provided for permitting deformation of said seal portion when said connected member is mounted on said frame.

12. A cartridge according to claim 8, wherein said connected member is a regulating member for regulating a layer thickness of developer carried by a developer carrying member.

13. A cartridge according to claim 8, wherein said connected member is a cleaning member for removing developer from a surface of an image bearing member.

14. A cartridge according to claim 8, wherein said connected member is a second frame different from said frame.

15. A cartridge according to claim 14, wherein the second frame is provided with a projection contacted to said seal portion.

16. An image forming apparatus for forming an image on a recording material, said image forming apparatus comprising:

a frame;

an accommodating portion, constituted by said frame, for accommodating developer;

a seal portion for preventing the developer from being leaked out from said accommodating portion, wherein said seal portion is formed by injection molding at a seal forming portion provided on said frame and is projected from said seal forming portion; and a sprue which is formed integrally with said seal portion by a resin material remaining in a path for permitting flow of the resin material melted when said seal portion is formed by the injection molding and which is projected from a surface of said frame at a position different from a position of said seal portion such that said sprue projects further in a direction perpendicular to said surface than said seal portion projects in the direction perpendicular to said surface.

17. An image forming apparatus according to claim 16, wherein said sprue is provided at the position different from the position of said seal portion with respect to a direction perpendicular to a longitudinal direction of said seal portion.

18. An image forming apparatus according to claim 16, wherein said seal portion is provided inside said accommodating portion.

19. An image forming apparatus according to claim 16, wherein said seal portion is inclined and projected from said seal forming portion.

20. An image forming apparatus according to claim 16, wherein said sprue is inclined and projected from said seal forming portion.

21. An image forming apparatus according to claim 16, wherein said seal portion and said sprue are close to each other with respect to a direction perpendicular to a longitudinal direction of said seal portion.

22. An image forming apparatus according to claim 16, wherein said seal portion is formed of an elastically deformable elastomer resin material.

23. An image forming apparatus according to claim 16, further comprising a connected member to be connected to said frame to constitute said accommodating portion and contactable to said seal portion.

24. An image forming apparatus according to claim 23, wherein said sprue is provided in a noncontact position with said connected member.

25. An image forming apparatus according to claim 23, wherein said seal portion and said sprue are in noncontact with each other in a state in which said connected member is mounted on said frame.

26. An image forming apparatus according to claim 23, wherein between said seal portion and said sprue a groove is provided for permitting deformation of said seal portion when said connected member is mounted on said frame is provided.

27. An image forming apparatus according to claim 23, wherein said connected member is a regulating member for regulating a layer thickness of developer carried by a developer carrying member.

28. An image forming apparatus according to claim 23, wherein said connected member is a cleaning member for removing developer from a surface of an image bearing member.

29. An image forming apparatus according to claim 23, wherein said connected member is a second frame different from said frame.

30. An image forming apparatus according to claim 29, wherein the second frame is provided with a projection contacted to said seal portion.

* * * * *